US010921055B2

(12) United States Patent
Jafa et al.

(10) Patent No.: US 10,921,055 B2
(45) Date of Patent: Feb. 16, 2021

(54) METHOD OF COOLING A BEVERAGE CONTAINER

(71) Applicant: PepsiCo, Inc., Purchase, NY (US)

(72) Inventors: Emad Jafa, Brewster, NY (US); Mikhail Verbitsky, Stoughton, MA (US); Andrey Balanev, St. Petersburg (RU); Georgy Martsinovskiy, St. Petersburg (RU); Vasilii Abashkin, St. Petersburg (RU)

(73) Assignee: PepsiCo, Inc., Purchase, NY (US)

( * ) Notice: Subject to any disclaimer, the term of this patent is extended or adjusted under 35 U.S.C. 154(b) by 0 days.

(21) Appl. No.: 16/543,054

(22) Filed: Aug. 16, 2019

(65) Prior Publication Data

US 2019/0368809 A1 Dec. 5, 2019

Related U.S. Application Data

(62) Division of application No. 14/597,718, filed on Jan. 15, 2015, now Pat. No. 10,386,117.

(51) Int. Cl.
*F25D 31/00* (2006.01)
*F25B 21/02* (2006.01)

(52) U.S. Cl.
CPC ..... *F25D 31/007* (2013.01); *F25B 21/02* (2013.01); *F25D 2325/00* (2013.01);
(Continued)

(58) Field of Classification Search
CPC ..... F25D 31/007; F25D 2700/12; F25D 2700/06; F25D 2331/805; F25D 2331/803;
(Continued)

(56) References Cited

U.S. PATENT DOCUMENTS 2,061,427 A 11/1936 King
4,417,450 A 11/1983 Morgan, Jr. et al.
(Continued)

FOREIGN PATENT DOCUMENTS

CN 201359419 Y 12/2009
CN 102308162 A 1/2012
(Continued)

OTHER PUBLICATIONS

Ben Coxworth, "V-Tex could be the "microwave cooler" that you wish existed", Oct. 29, 2013, pp. 1-6, [retrieved on Jan. 15, 2015]; Retrieved from the Internet <URL: http://www.gizmag.com/rapidcool-v-tex-instant-cooler/29589/>.
(Continued)

*Primary Examiner* — Steve S Tanenbaum
(74) *Attorney, Agent, or Firm* — Sterne, Kessler, Goldstein & Fox P.L.L.C.

(57) ABSTRACT

Methods and apparatuses are provided for cooling of beverages containers, such as cans or bottles, quickly, or on demand. An apparatus may provide for quickly cooling a number of beverage containers when power is available and for storing them, once they have been cooled. The apparatus may include a thermoelectric cooler configured to rapidly cool a beverage container in a cooling cell. The methods may include detecting the presence of a beverage container in a cooling cell and cooling the beverage container to a selected temperature. The availability of external power may be detected and a rapid cooling of a beverage container may begin when power becomes available.

20 Claims, 8 Drawing Sheets

(52) U.S. Cl.
CPC .. *F25D 2331/803* (2013.01); *F25D 2331/805* (2013.01); *F25D 2400/12* (2013.01); *F25D 2600/02* (2013.01); *F25D 2700/06* (2013.01); *F25D 2700/12* (2013.01); *F25D 2700/16* (2013.01)

(58) Field of Classification Search
CPC ..... F25D 2325/00; F25D 2400/12; F25D 2600/02; F25D 2700/16; F25B 21/02
USPC ..... 62/3.6, 3.64
See application file for complete search history.

(56) References Cited

U.S. PATENT DOCUMENTS

| | | | | |
|---|---|---|---|---|
| 4,910,976 | A | 3/1990 | Drummond, III et al. | |
| 5,191,773 | A | 3/1993 | Cassell | |
| 5,720,171 | A | 2/1998 | Osterhoff et al. | |
| 6,412,286 | B1 | 7/2002 | Park et al. | |
| 7,856,831 | B2 * | 12/2010 | Flinner | F25C 1/04 62/3.2 |
| 2003/0074903 | A1 * | 4/2003 | Upadhye | F25D 31/005 62/3.3 |
| 2004/0068992 | A1 | 4/2004 | Cauchy | |
| 2007/0204629 | A1 * | 9/2007 | Lofy | B60N 3/108 62/3.61 |
| 2007/0278202 | A1 * | 12/2007 | Long | A47J 31/20 219/214 |
| 2009/0038317 | A1 * | 2/2009 | Otey | F25B 21/04 62/3.2 |
| 2009/0056369 | A1 | 3/2009 | Fink et al. | |
| 2010/0018223 | A1 * | 1/2010 | Sundhar | F25D 31/007 62/3.63 |
| 2010/0281909 | A1 * | 11/2010 | Carpanzano | B67D 3/0083 62/386 |
| 2010/0293970 | A1 | 11/2010 | Mooijer et al. | |
| 2011/0011099 | A1 * | 1/2011 | Linder | A47F 1/10 62/3.6 |
| 2011/0186591 | A1 * | 8/2011 | Pfister | F25D 31/007 221/97 |
| 2011/0289939 | A1 * | 12/2011 | Lu | F25B 21/04 62/3.3 |
| 2012/0016524 | A1 | 1/2012 | Spicer et al. | |
| 2013/0036841 | A1 * | 2/2013 | Naboulsi | G08B 21/06 73/865.8 |

FOREIGN PATENT DOCUMENTS

| | | | |
|---|---|---|---|
| CN | 104083097 | A | 10/2014 |
| JP | H0552455 | A | 3/1993 |
| JP | 3031236 | U | 11/1996 |
| JP | 2001174122 | A | 6/2001 |
| JP | 2007139270 | A | 6/2007 |
| JP | 2009248869 | A | 10/2009 |
| JP | 2014020641 | A | 2/2014 |
| KR | 10-2006-0114593 | A | 11/2006 |
| KR | 10-0775518 | B1 | 11/2007 |

OTHER PUBLICATIONS

"Peltier soda cooler builds", Jul. 25, 2012, p. 1, [retrieved on Jan. 15, 2015]; Retrieved from the Internet <URL: http://www.overclock.net/t/1286097/peltier-soda-cooler-buiIds>.

Tee Peltier.com, Thermo Electric Cooling, the Peltier effect, Dec. 12, 2013, pp. 1-6, [retrieved on Jan. 15, 2015]; Retrieved from the Internet <URL: http://www.tecpeltier.com/view1opic.php?f=4&t=1732>.

International Search Report and Written Opinion of the International Searching Authority for International Application No. PCT/US2016/013382, dated Mar. 17, 2016 (7 pages).

* cited by examiner

METHOD OF COOLING A BEVERAGE CONTAINER

CROSS-REFERENCE TO RELATED APPLICATIONS

This application is a divisional of U.S. patent application Ser. No. 14/597,718, filed Jan. 15, 2015, which is incorporated herein in its entirety by reference thereto.

BACKGROUND

Chilled beverages, in cans, bottles or other containers, are often sold at convenience stores and grocery stores. Beverage containers are typically placed inside a refrigerator for cooling, prior to purchase by a customer. Conventional refrigerators cool an interior of a chamber using a vapor-compression cycle, whereby a fan blows air across an evaporator coil to provide convective cooling of the interior of the chamber. Beverage containers may be placed in the chamber and, over time, the beverages may become cooled. When starting with a typical chamber full of cans or bottles of beverages at room temperature, for example in a warm climate, the time required for the beverages to reach a desirable chilled temperature may be ten hours or more.

This is particularly troublesome in locations where electricity may be inconsistently available. In these locations, a conventional refrigerator may not have a supply of electricity for a period of time sufficient to cool the interior chamber and any beverages inside. This leads to a poor consumer experience because the beverages may never reach a preferred chilled temperature.

In some locations, electricity may be expensive such that vendors may prefer not to run a refrigerator during hours when their shop is closed. These vendors may unplug their refrigerator, for example, upon closing their shop for the night. When the shop opens in the morning, the refrigerator may be plugged back in, but the contents of the refrigerator may not become cool before purchased by a consumer, thereby providing a poor consumer experience.

In addition, conventional refrigerators cool an interior chamber and its contents, regardless of customer demand for those contents. In periods of low sales, this may result in the needless cooling of beverages.

Therefore, improved systems and methods to address these and other shortcomings in the art are desired.

SUMMARY

In light of the foregoing background, the following presents a simplified summary of the present disclosure in order to provide a basic understanding of some aspects described herein. This summary is not an extensive overview, and is not intended to identify key or critical elements or to delineate the scope of the claims. The following summary merely presents various described aspects in a simplified form as a prelude to the more detailed description provided below.

One or more aspects of the disclosure relate to methods for cooling of beverages containers, such as cans or bottles, quickly, or on demand. The methods may include detecting the presence of a beverage container in a cooling cell and cooling the beverage container to a selected temperature. Some aspects of the disclosure relate to detecting the availability of external power and performing rapid cooling of a beverage container when power is available.

Aspects of the disclosure may include an apparatus for quickly cooling a number of beverage containers and for providing storage for them, once they have been cooled. The apparatus may include a thermoelectric cooler configured to rapidly cool a beverage container in a cooling cell.

The summary here is not an exhaustive listing of the novel features described herein, and are not limiting of the claims. These and other features are described in greater detail below.

BRIEF DESCRIPTION OF THE DRAWINGS

Some features herein are illustrated by way of example, and not by way of limitation, in the accompanying drawings. In the drawings, like numerals reference similar elements between the drawings.

DETAILED DESCRIPTION

In the following description of various illustrative embodiments, reference is made to the accompanying drawings, which form a part hereof, and in which is shown, by way of illustration, various embodiments in which aspects of the disclosure may be practiced. It is to be understood that other embodiments may be utilized and structural and functional modifications may be made, without departing from the scope of the present disclosure.

Figure 1:
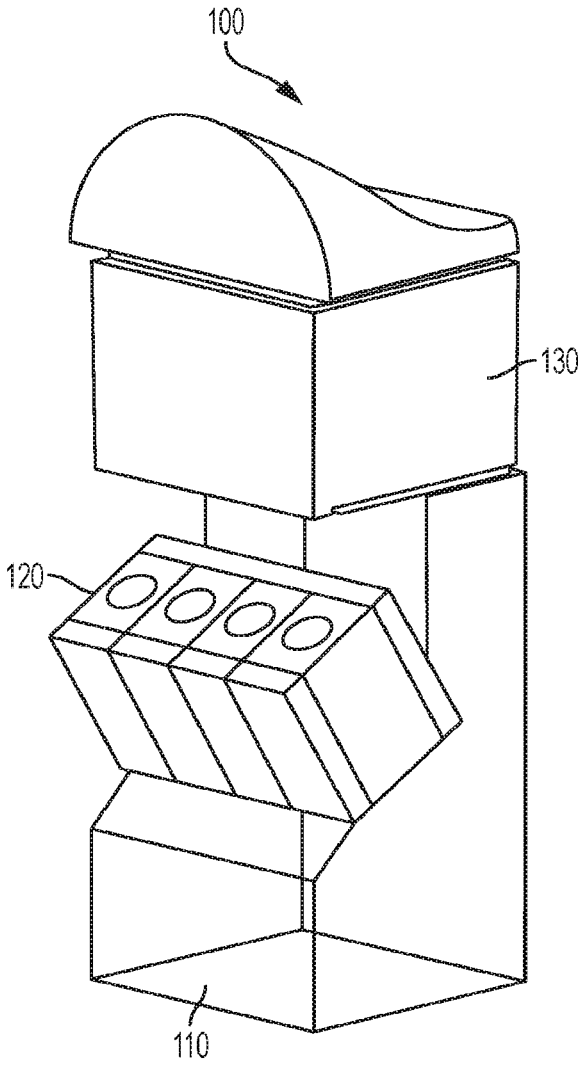
FIG. 1 illustrates an example beverage cooler in accordance with aspects of the present disclosure.

FIG. 1 illustrates an example beverage cooler 100. A frame 110 may support a four-cell cooling engine 120 and a post-chill storage chamber 130. In various embodiments, the post-chill storage chamber 130 and the cooling engine 120 may be mounted in various positions and orientations. FIG. 1 depicts one of the many possible arrangements.

Figure 2:
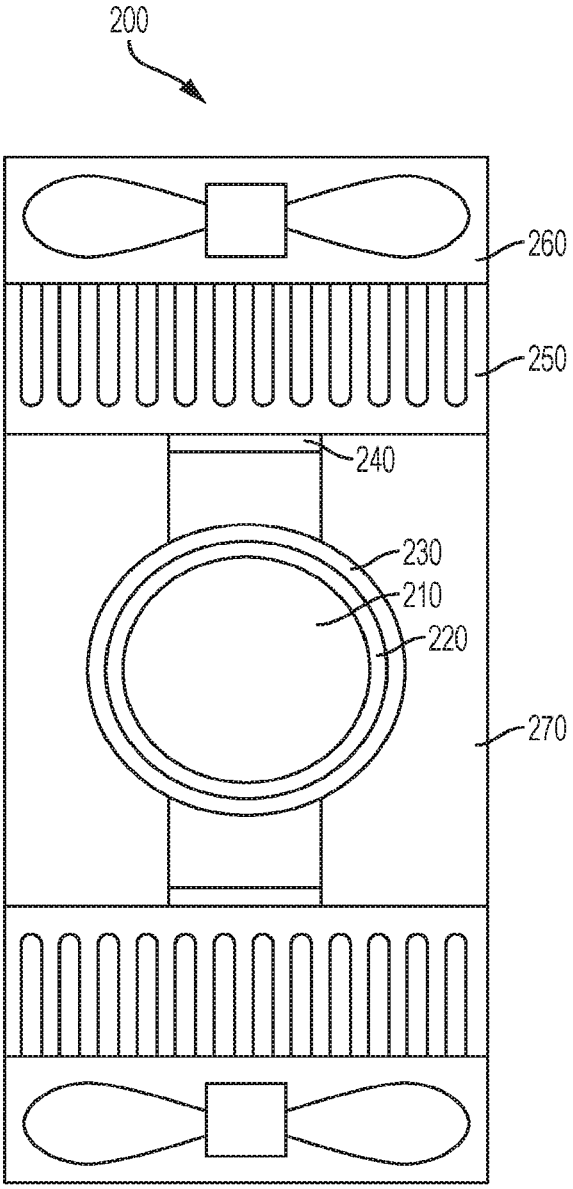
FIG. 2 illustrates an example cooling cell in accordance with aspects of the present disclosure.

FIG. 2 illustrates a view from above cooling cell 200, as may be included in cooling engine 120. Cup holder 230 may be a cylindrical shaped cup with a closed bottom and an open top so that beverage containers may be placed into cup holder 230 from above. Cup holder 230 may be constructed of a heat conducting material, such as aluminum.

Area 210 depicts where a beverage container may be placed in cup holder 230. Area 210 may accept a particular size or shape of beverage container, for example, a 12 oz. can or a 20 oz. bottle, or area 210 may be of such dimensions so as to accept a range of beverage containers of various sizes and shapes. Cooling cell 200 may cool beverage containers of any type, including plastic bottles, aluminum cans, glass bottles, etc.

Gap filler 220 may fill a space between cup holder 230 and a beverage container placed therein. In some embodiments, it may be preferred to have a snug fit among the beverage container, the gap filler 220 and the cup holder 230, in order to provide a maximum amount of contact to enhance the transfer of heat. In some embodiments, the use of a liquid as a gap filler may provide a preferred level of heat transfer, but consumers may not like that the beverage container becomes wet while it is being cooled.

In some embodiments, gap filler 220 may include one or more liquid or gel filled bags, such as polyethylene bags, between the cup holder 230 and the beverage container. A liquid or gel filled bag may provide heat transfer similar to a liquid alone, but provide the benefit of not making the beverage containers wet. In some embodiments, the bag may contain a liquid, such as water, which may improve heat conduction. In other embodiments, air, water, or other material may be used to fill any gap between cup holder 230 and the beverage container. Still other embodiments may use steel wool, heat conductive resin or thermo conductive rubber, for example. Materials with higher thermal conductivity may transfer heat better than materials with a lower thermal conductivity. In some embodiments, gap filler 220 may include a mixture of materials. For example, gap filler 220 may include a bag containing a mixture of water and ceramic micro spheres.

In some embodiments, gap filler 220 may include a liquid filled bag or bags sized to fit snuggly with a particular size or shape of beverage container. For example, a particular bag or bags may fit into the cup holder 230 with a 12 oz. beverage can. A smaller bag or bags may fit into cup holder 230 with a 20 oz. beverage bottle. In some embodiments, various sized gap fillers 220 may be selectable by a vendor to correspond to the size of the beverage container that the vendor intends to cool. In some embodiments, the gap filler may be selected by the manufacturer of the cooling system. In other embodiments, the vendor may be provided with a number of various sized gap fillers 220 and the vendor may select the gap filler 220 to best fit the beverage container. In some embodiments including a multi-cell cooling engine, a different sized gap filler 220 may be used in each cell, for example, in order to provide optimal cooling cells for a different sized beverage containers.

In some embodiments, one or more thermoelectric coolers (TEC) 240 may be affixed to cup holder 230 to provide for cooling of the cup holder. The TEC may be selected from currently available TEC devices, such as the RIME-74 from Kryotherm of Saint-Petersburg, Russia. In some embodiments, thermoelectric coolers 240 may be placed on opposite sides on the cup holder 230, as depicted in FIG. 2. In other embodiments, thermoelectric coolers 240 may be affixed to other surfaces of cup holder 230, such as a bottom surface or an inner surface. In other embodiments, one or more thermoelectric coolers 240 may be positioned to make contact with a beverage container, when the beverage container is placed into cup holder 230. As an example, cup holder 230 may have an opening on a side or bottom where a thermoelectric cooler 240 may protrude through and make contact with a beverage container placed therein.

When a voltage, for example 12 VDC, is applied across the terminals of a TEC, one side of the TEC may become cold while the other may become hot. In the embodiment depicted in FIG. 2, the cold side of the TEC 240 may be affixed to the cup holder 230 so that the cup holder becomes colder when a voltage is applied to the TEC. As can be appreciated by those skilled in the art, the number, type and size of the TECs 240 selected may determine how quickly a beverage container may be cooled. In some embodiments, a beverage container may be cooled from an ambient temperature to a desired temperature, such as 45 degrees F., in one hour or less, much faster than would be possible with a conventional refrigerator.

In some embodiments, heat sink 250 may be attached to the hot side of the TEC 240 in order to dissipate heat from the TEC. In some embodiments, fan 260 may be positioned to blow air across heat sink 250, to aid in cooling the TEC 240. In some embodiments, fan 260 may be operated in conjunction with a thermostat so that the fan runs when a high temperature is detected in proximity to heat sink 250. In some other embodiments, fan 260 may be operated whenever voltage is applied to TEC 240.

In some embodiments, an insulating material 270 may insulate cup holder 230 from ambient air. This may increase the operating efficiency of the cooling cell.

In some embodiments, multiple cooling cells 200 may be arranged in a structure, such as cooling engine 120, providing the capability for cooling a number of beverages at the same time. For example, some embodiments may include four cooling cells, while other embodiments may include six cooling cells. In some embodiments, the number of cooling cells may be chosen in order to meet an expected level of consumption, such that the beverage cooler 100 may provide cooled beverages at a rate approximately equal to an expected consumption rate. Therefore, cooled beverages may be available for customers to meet a demand. In some embodiments, cooling cells 200 may be modular so that various configurations of cooling engines can be readily assembled or manufactured. For example, one cooling engine may include six cooling cells, while another cooling engine may include three, or some other quantity, of cooling cells.

In some embodiments, a vapor compression cooler may be used instead of TEC 240. In such embodiments, evaporator coils may be wrapped around cup holder 230 in order to provide heat transfer away from cup holder 230.

Figure 3:
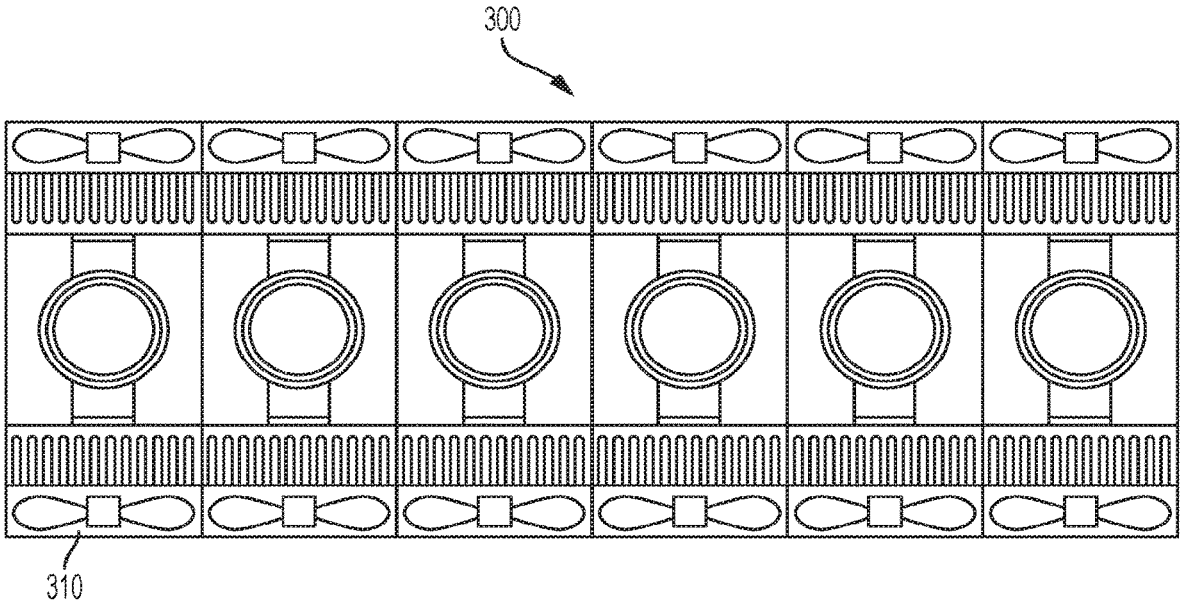
FIG. 3 illustrates an embodiment of a six cell cooling engine in accordance with aspects of the present disclosure.

FIG. 3 illustrates an example embodiment of a six cell cooling engine 300. Each cooling cell 310 in the illustration may comprise a thermoelectric cooling cell. In some embodiments, each of the cooling cells 310 in cooling engine 300 may be independently controlled. In other embodiments, multiple cooling cells 310 in cooling engine 300 may be coordinated such that they operate as a unit. For example, cooling in all of the cooling cells may start or stop at the same time, or various temperature sensors may take readings from particular cooling cells, rather than from all of the cooling cells, in some embodiments. In other embodiments, a subset of the cooling cells 310 may operate as a unit. The number of cooling cells 310 operating as a unit may be configurable in some embodiments.

Figure 4:
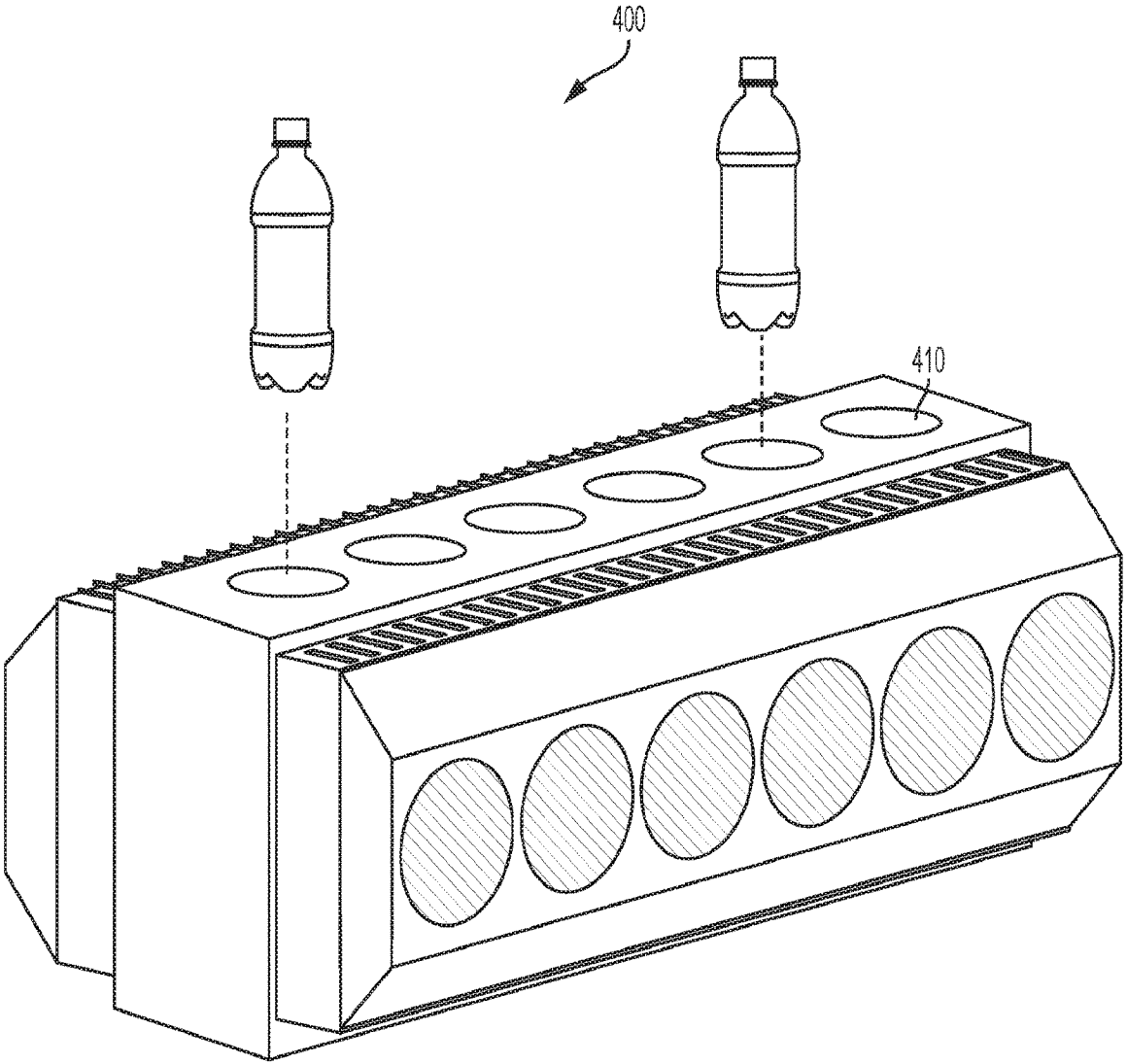
FIG. 4 illustrates another embodiment of a six cell cooling engine in accordance with aspects of the present disclosure.

FIG. 4 depicts another embodiment of a six cell cooling engine 400. A beverage container may be loaded into cup holder 410 from above.

Figure 5:
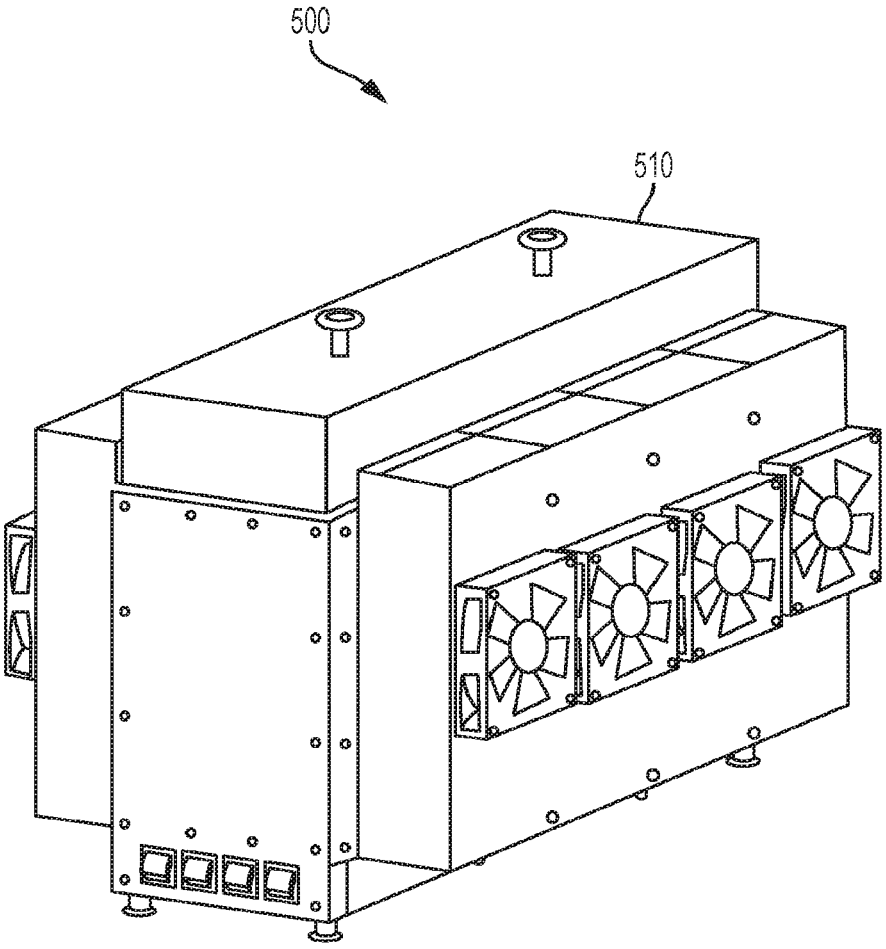
FIG. 5 illustrates an embodiment of a four cell cooling engine in accordance with aspects of the present disclosure.

FIG. 5 depicts an example embodiment of a four cell cooling engine 500. In some embodiments, a removable cover 510 may insulate a top portion of the cooling engine. Cover 510 may be removed in order to allow access for loading or unloading of beverage containers from the cooling engine.

Referring again to FIG. 1, in some embodiments, post-chill storage chamber 130 may be used for storing of beverage containers after they have been chilled by the cooling engine 120. The post-chill storage chamber 130 may provide space for storing a number of beverage containers, for example, 36 cans or bottles. The post-chill storage chamber 130 may be of various sizes and may be sized appropriately for the expected market. For example, a post-chill storage chamber 130 in a small store with few customers may be of a smaller size, suitable for storage of 12 bottles or cans, while a post-chill storage chamber 130 in a high traffic location, where many consumers may require chilled beverages, may have be of a larger size, suitable for storage of 48 bottles or cans.

The post-chill storage chamber 130 may include an insulated box, in some embodiments, in order to prevent warming of the cooled beverages stored within. The post-chill storage chamber 130 may be cooled in some embodiments. Cooling of the post-chill storage chamber 130 may be provided by a refrigeration system. In some embodiments, cooling of the post-chill storage chamber 130 may be provided by one or more thermoelectric coolers. In other embodiments, cooling for the post-chill storage chamber 130 may be provided by harvesting cool air or water from cooling engine 120. In still other embodiments, cooling for the post-chill storage chamber 130 may be provided by a vapor compression device.

Once beverage containers have been chilled in the cooling engine 120, they may be removed from the cooling engine and placed in the post-chill storage chamber 130. The post-chill storage chamber 130 may be insulated such that it may retain the temperature of the chilled beverages inside for a period of 4 to 6 hours, for example.

Figure 6:
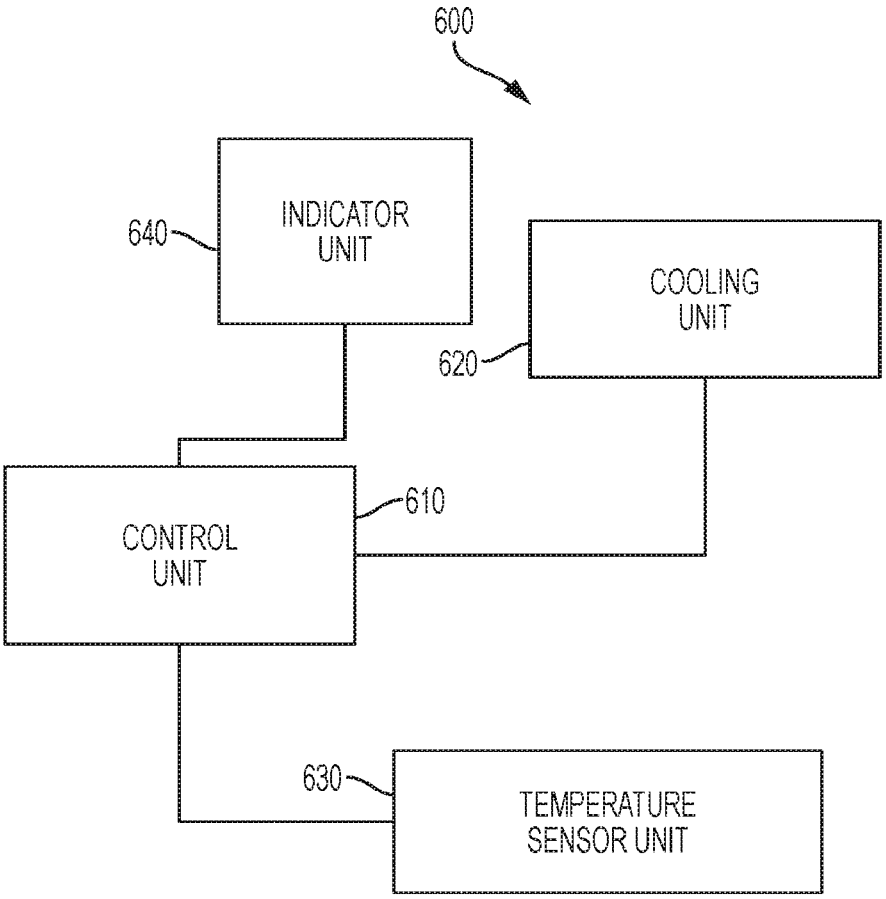
FIG. 6 illustrates an example system diagram in accordance with aspects of the present disclosure.

FIG. 6 illustrates an example system 600 for operating beverage cooler 100, as may be used in some embodiments. Control unit 610 may receive input from a user, such as a vendor, and control operation of the beverage cooler 100.

In some embodiments the control unit 610 may include a processor. The processor may execute computer executable instructions from a computer-readable medium, e.g., memory, in order to operate beverage cooler 100. Computer storage media may include volatile and nonvolatile, removable and non-removable media implemented in any method or technology for storage of information such as computer readable instructions, data structures, program modules or other data. Computer storage media include, but is not limited to, random access memory (RAM), read only memory (ROM), electronically erasable programmable read only memory (EEPROM), flash memory or other memory technology, CD-ROM, digital versatile disks (DVD) or other optical disk storage, magnetic cassettes, magnetic tape, magnetic disk storage or other magnetic storage devices, or any other medium that can be used to store the desired information and that can be accessed by the processor. The executable instructions may carry out any or all of the method steps described herein. With some embodiments, control unit 610 may comprise one or more processors.

In other embodiments, control unit 610 may be constructed of discrete components, such as resistors, capacitors, timers and transistors, etc. Control unit 610 may control power to cooling unit 620. Cooling unit 620 may include one or more thermoelectric coolers 240. Each thermoelectric cooler may be fitted with a heat sink 250. Each heat sink may have a corresponding fan 260 for heat removal. In some embodiments, the number of fans 260 may be fewer than the number of heat sinks 250. The control unit 610 may provide power and control to fan 260 and thermoelectric cooler 240. In some embodiments, control unit 610 may be programmable, such that cooling may be automatically started or stopped according to a time of day. For example, control unit 610 may be programmed to begin cooling beverage containers an hour before the opening time of a convenience store. Similarly, control unit 610 may be programmed to stop cooling at the closing time of the store.

In some embodiments, control unit 610 may include battery power and may monitor the availability of electric power, for example from an electric power utility company, controlling the operation of the cooling unit 620 to cool when power becomes available. Control unit 610 may perform various other functions to optimize the cooling process in environments where electric power may be sporadically available. For example, upon determining that electric power has been restored, after a period without power, control unit 610 may automatically begin the cooling of one or more cooling cells. In some embodiments, control unit 610 may determine the time of day upon power restoration and, depending on the time of day, may automatically begin the cooling of one or more cooling cells.

Temperature sensor unit 630 may provide various temperature data to control unit 610, for example, so that the control unit may efficiently control the operation of beverage cooler 100. In some embodiments, temperature sensor unit 630 may include one or more temperature sensors placed near various components of beverage cooler 100. In various embodiments, the temperature sensor unit 630 may include ambient temperature sensors and/or temperature sensors to measure temperatures related to cup holder 230, gap filler 220, heat sink 250, thermoelectric cooler 240, fan 260, and the beverage containers, among others.

In some embodiments, indicator unit 640 may provide an indication of the operational state of various components or areas in the beverage cooler 100. For example, indicator unit 640 may include one or more LEDs that may be illuminated by control unit 610 when one or more beverage containers have reached a target temperature. In other embodiments, one or more indications may be provided when cooling has started or stopped. In some embodiments, an indication may be provided corresponding to the status of various components of the beverage cooler, for example, to indicate an overheat condition of thermoelectric cooler 240. One or more of the units illustrated in FIG. 6 may include hardware components and/or software.

Figure 7:
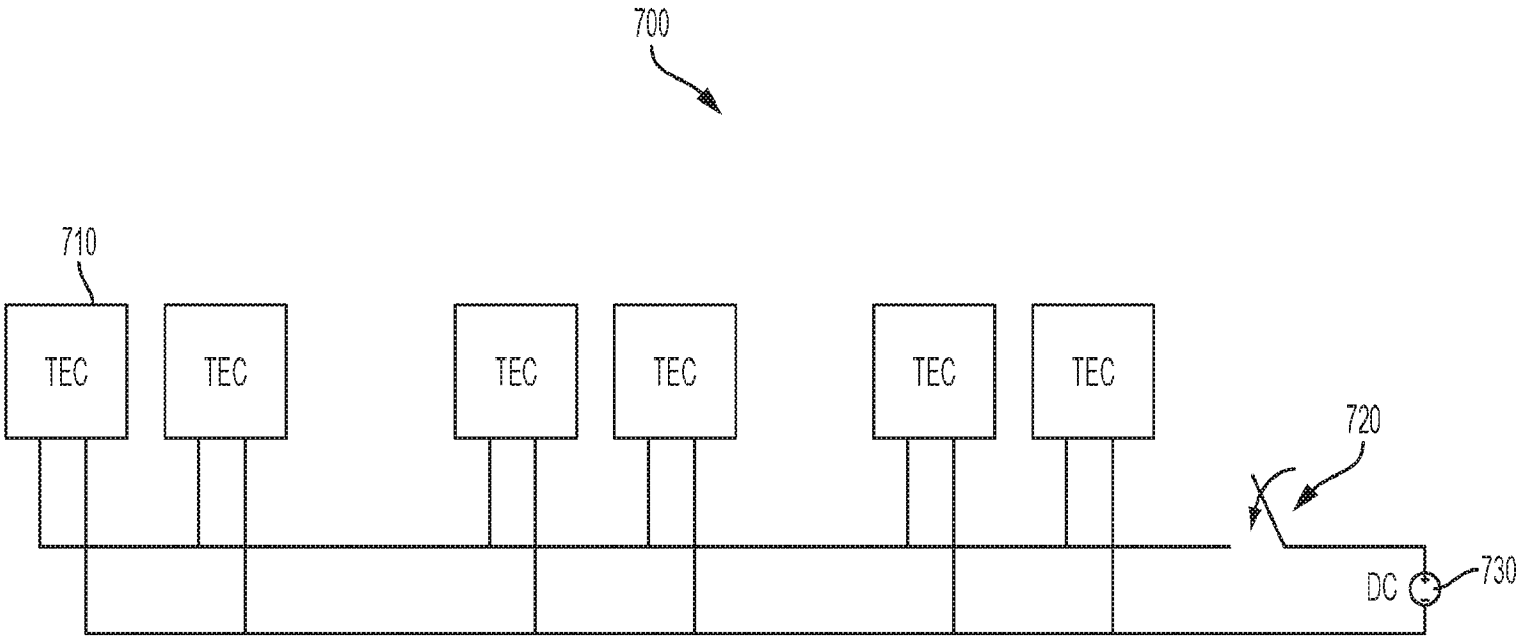
FIG. 7 illustrates an example circuit for a three cell cooling engine in accordance with aspects of the present disclosure.

FIG. 7 illustrates an example circuit 700 for controlling a three cell cooling engine. Thermoelectric coolers 710 may be connected in parallel to a voltage source 730. Upon closing of switch 720, a voltage may be applied across thermoelectric coolers 710 thereby causing them to function as cooling devices. The circuit illustrated may be used, for example, to control a three cell cooling engine where each cooling cell may include two thermoelectric coolers. The illustration depicts a DC voltage source, but it should be understood by those skilled in the art that various voltage waveforms may be advantageously used.

Figure 8:
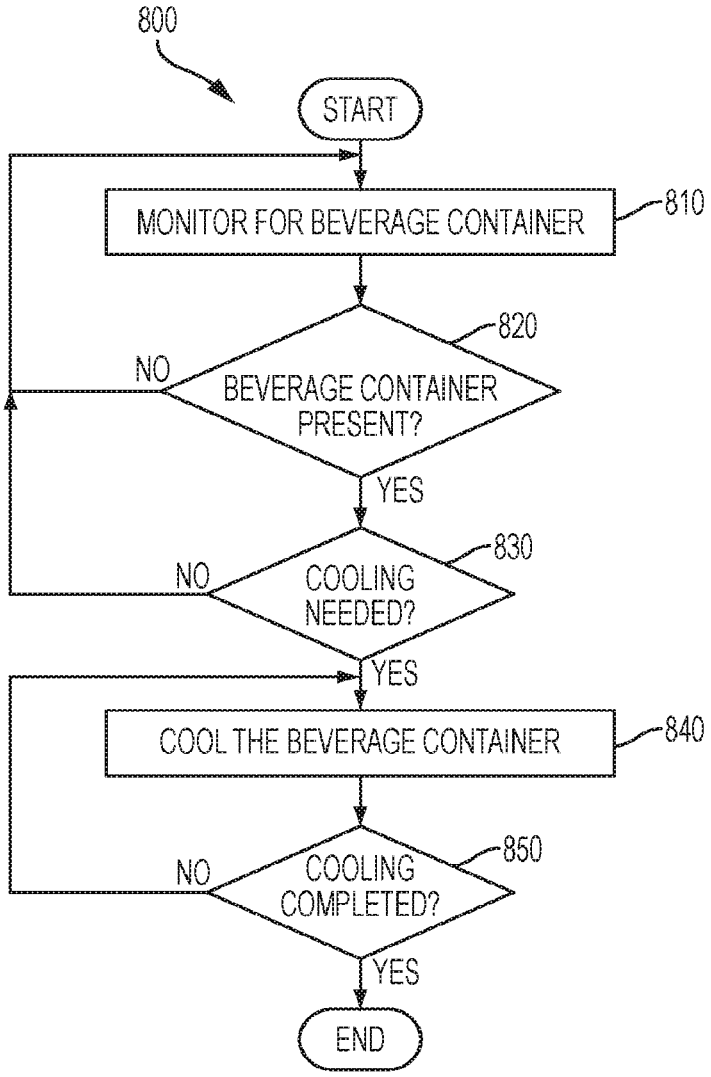
FIG. 8 illustrates a flow diagram of an example process in accordance with aspects of the present disclosure.

FIG. 8 illustrates an example process flow 800 in accordance with some aspects of the present disclosure. At step 810 a cooling cell 200 may be monitored in order to detect the presence of a beverage container. At step 820, it may be detected whether a beverage container is present or not. In some embodiments, a sensor, such as a weight sensor, an optical sensor, a capacitive sensor, or other sensor, may detect the presence of a beverage container in the cooling cell. For example, in embodiments using a weight sensor, the weight sensor may be mounted in the bottom of the cup holder 230 and sense the weight of the beverage container, once the beverage container is placed into the cup holder 230.

If no beverage container is detected, then the process may continue at step 810. If a beverage container is detected in step 820, then the process may move to step 830 where it is determined whether cooling is needed or not. In some embodiments, various temperature sensors, such as those in the temperature sensor unit 630, may be checked to determine a temperature of the beverage or of the beverage container. If it is determined that a temperature is higher than a pre-determined temperature, for example 45 degrees F., it may be determined that cooling is needed and the process may continue at step 840. If it is determined that a temperature is less than the pre-determined temperature, then the process may continue at step 810. At step 840, a voltage may be applied to TEC 240 in order to cool the beverage container. In some embodiments, various cooling parameters may be determined based on the weight of the beverage container and the temperature of the beverage or beverage container. For example, the amount of cooling required or length or cooling time needed may be determined based on the weight and temperature of the beverage container. At step 850, it may be determined whether the beverage has been cooled to the pre-determined temperature. If so, the process may end. If not, the process may continue at step 840, where the beverage container may continue to be cooled.

In some embodiments, when a vendor wants to prepare chilled beverages, the vendor may place a beverage container, such as a bottle, into one or more of the cooling cells 200. The vendor may put cover 510 over the cells as an insulator.

In some embodiments, an on/off switch may be actuated to start the cooling process. In other embodiments, control unit 610 may start the cooling process when a beverage container is detected.

Upon initiation of the cooling process, electrical power, such as 12 VDC, may be supplied to the thermoelectric cooler 240. Cooling fans 260 may start at the same time or the cooling fans may be thermostatically controlled to start at a particular temperature measured in proximity to TEC 240 or heat sink 250.

In some embodiments, the cooling process may be manually controlled, such that a vendor may switch off the cooling, for example, after a period of time. One or more cooling cells 200 may operate as a unit or individually in various embodiments. In some embodiments, the cooling process may automatically halt when a temperature sensor detects a particular temperature, for example, a desired beverage temperature. In some embodiments, the temperature sensor may sense the temperature of a cooling cell. In other embodiments, the temperature sensor may sense the temperature of an area near a beverage container, such as the temperature of the gap filler. Various embodiments for determining or estimating the temperature of the beverage container can be envisioned and are included herein.

In some other embodiments, a timer may be started to initiate the cooling process and/or halt the cooling process upon expiration of the timer. In some embodiments, the timer may have various manual settings such that a vendor may set a particular duration for the cooling process. For example, a vendor may be familiar with the required timing for beverages to reach a particular temperature and the vendor may set the timer, such as a dial, to a particular time or setting in order to achieve the desired temperature. In other embodiments, the cooling process may be thermostatically controlled to halt when a particular temperature is detected.

In some embodiments, the cooling process may cool one or more cooling cells 200. In some embodiments, the cooling process may cool all cooling cells while, in other embodiments, particular cooling cells may be cooled while others may not be cooled. Since the cooling engine 120 may be modular, as explained above, various numbers of cooling cells 200 may be available in any embodiment of the beverage cooler 100.

In order to operate efficiently with regards to power usage, some embodiments of the system may have individually controlled cooling cells 200 such that one or more cooling cells may be operated individually. For example, the one or more cooling cells may each have an on/off switch and/or a sensor to detect a beverage container and each cell may cool by its own schedule. In these examples, a vendor may load a subset of the cooling cells and cool only those cooling cells. This may be useful in cases where there is low demand for chilled beverages, for example, and enables the vendor to cool fewer beverages.

In some embodiments, an indicator may indicate when the cooling process has completed. The indicator may be audible, visual, haptic or other type. In some embodiments, an indicator may indicate when all cooling cells 200 have completed the cooling process to a desired temperature. In other embodiments, separate indicators may be associated with each cooling cell 200 such that each cooling cell can be independently operated and indicate when the cooling process has completed.

In some embodiments, the indicator may be turned on or off after a pre-determined period of time, for example, in embodiments where the cooling process is time controlled. In other embodiments, the indicator may be turned on or off when a temperature sensor detects that a desired temperature has been reached.

Once a beverage container has been chilled to a desired temperature, a vendor may remove the beverage container from the cooling cell and place the beverage container into the post-chill storage chamber 130 for storage, until a customer purchases the beverage container. The cooling cell 200 may be reloaded and the cooling process repeated, in order to cool more beverage containers.

In some embodiments, a beverage container may remain in the cooling cell 200 after the cooling process has completed. This may be useful in embodiments where a post-chill storage container 130 may not be available or when the post-chill storage container may be full of beverage containers. In some of these embodiments, a temperature of the cooling cell 200 may be monitored and the cooling process may be turned on and off as needed in order to keep the beverage container within a particular temperature range until the beverage container is removed from the cooling cell, for example, when it may be removed for purchase by a customer.

While the invention has been described with respect to specific examples including presently preferred modes of carrying out the invention, those skilled in the art will appreciate that there are numerous variations and permutations of the above described systems and techniques that fall within the spirit and scope of the invention as set forth in the appended claims.

What is claimed is:

1. A method of cooling a beverage container in a retail setting, the method comprising:

detecting a beverage container in a cup holder, wherein the cup holder is part of a cooling engine supported by a frame configured for placement in the retail setting, the cup holder in thermally conductive contact with the beverage container through a gap filler;

determining a temperature of the beverage container;

cooling, by a cooling device, the beverage container to a selected temperature; and after cooling the beverage container to the selected temperature, storing the beverage container in an insulated storage chamber separate from the cooling engine to prevent warming, wherein the insulated storage chamber is supported by the frame, and wherein the cooling engine is mounted to the frame outside of the insulated storage chamber.

2. The method of claim 1, wherein the cooling device comprises a thermoelectric cooler.

3. The method of claim 1, further comprising:

providing an indication when the beverage container has reached the selected temperature.

4. The method of claim 3, wherein the indication comprises an audible alert or a visual indication.

5. The method of claim 1, further comprising:

detecting a loss of external power;

detecting a restoration of external power; and automatically cooling, by the cooling device, the beverage container to the selected temperature, depending on a time of day.

6. The method of claim 1, further comprising:

halting the cooling at a first time and starting the cooling at a second time, the first time and the second time configurable.

7. The method of claim 1, wherein the detecting comprises at least one of: a weight measurement, a capacitive measurement, an optical measurement or a resistive measurement.

8. The method of claim 1, the cooling further comprising:

determining a weight of the beverage container;

calculating a temperature delta, the temperature delta comprising a difference between the temperature of the beverage container and the selected temperature;

determining a cooling parameter, based on the weight and the temperature delta; and cooling the beverage according to the cooling parameter.

9. The method of claim 8, wherein the cooling parameter comprises a cooling time.

10. The method of claim 1, further comprising cooling the insulated storage chamber.

11. The method of claim 1, further comprising:

automatically stopping the cooling at a first time of day, wherein the automatic stopping is independent of the temperature of the beverage container; and automatically starting the cooling at a second time of day, wherein the first time of day and the second time of day are configurable.

12. The method of claim 11, wherein the first time of day is a closing time of the retail setting.

13. The method of claim 11, wherein the second time of day is based on an opening time of the retail setting.

14. The method of claim 11, wherein the second time of day is an amount of time before an opening time of the retail setting.

15. The method of claim 11, wherein the second time of day is one hour before an opening time of the retail setting.

16. The method of claim 11, further comprising monitoring a temperature of the cup holder and turning the cooling on and off to keep the beverage container within a temperature range until the beverage container is removed from the cup holder.

17. The method of claim 1, further comprising:

detecting a loss of external power;

detecting a restoration of external power after a period without power;

after detecting the restoration of external power, determining a time of day; and automatically starting the cooling of the beverage container to the selected temperature upon the restoration of external power, depending on the determined time of day.

18. The method of claim 17, wherein the cooling automatically starts when the time of day is a time at which the retail setting is open.

19. The method of claim 17, wherein the cooling does not automatically start when the time of day is a time at which the retail setting is closed.

20. The method of claim 17, further comprising, after cooling the beverage container to the selected temperature, storing the beverage container in an insulated storage chamber to prevent warming.

* * * * *